US011398710B2

(12) United States Patent
Anderson et al.

(10) Patent No.: US 11,398,710 B2
(45) Date of Patent: Jul. 26, 2022

(54) PROTECTIVE BARRIER FOR THE DIELECTRIC MATERIALS OF AN ELECTRICAL CONNECTION/INTERFACE IN AN OIL WELL ENVIRONMENT AND A METHOD OF FORMING THE SAME

(71) Applicants: David Anderson, Avon, CO (US); Myles Keefer, Huntington Beach, CA (US); Larry Le, Corona, CA (US)

(72) Inventors: David Anderson, Avon, CO (US); Myles Keefer, Huntington Beach, CA (US); Larry Le, Corona, CA (US)

( * ) Notice: Subject to any disclaimer, the term of this patent is extended or adjusted under 35 U.S.C. 154(b) by 74 days.

(21) Appl. No.: 15/929,712

(22) Filed: May 18, 2020

(65) Prior Publication Data

US 2020/0366044 A1 Nov. 19, 2020

Related U.S. Application Data

(60) Provisional application No. 62/849,460, filed on May 17, 2019.

(51) Int. Cl.
*H01R 43/20* (2006.01)
*H01R 13/533* (2006.01)

(52) U.S. Cl.
CPC ..... *H01R 43/20* (2013.01); *H01R 13/533* (2013.01)

(58) Field of Classification Search
CPC ..... E21B 41/00; H01R 13/6599
See application file for complete search history.

(56) References Cited

U.S. PATENT DOCUMENTS

| | | | | |
|---|---|---|---|---|
| 2,858,108 | A * | 10/1958 | Wise | E21B 7/24 175/56 |
| 3,906,435 | A * | 9/1975 | Lamel | G01H 1/10 367/81 |
| 4,722,402 | A * | 2/1988 | Weldon | E21B 4/12 175/104 |
| 4,899,834 | A * | 2/1990 | Weldon | E21B 4/12 175/104 |
| 4,914,433 | A * | 4/1990 | Galle | E21B 47/13 340/854.4 |
| 8,604,632 | B2 * | 12/2013 | Hardin, Jr. | F03B 13/00 290/43 |
| 9,322,245 | B2 * | 4/2016 | Nicholson | E21B 17/025 |
| 10,350,716 | B2 * | 7/2019 | Tkaczyk | H05B 3/06 |
| 10,577,881 | B2 * | 3/2020 | Schultz | E21B 7/24 |
| 2008/0026623 | A1 * | 1/2008 | Emerson | H02G 9/06 439/275 |
| 2013/0309888 | A1 * | 11/2013 | Nicholson | E21B 36/00 439/271 |

* cited by examiner

*Primary Examiner* — Jean F Duverne
(74) *Attorney, Agent, or Firm* — Dunlap Bennett & Ludwig, PLLC

(57) ABSTRACT

A method for protecting an electrical interface in an oil well environment, the method providing the deposition/application of a metallic layer onto a thermoplastic substrate of a conductor of the electrical interface to create an impermeable barrier between a metallic encapsulating material and the thermoplastic substrate.

3 Claims, 2 Drawing Sheets

PROTECTIVE BARRIER FOR THE DIELECTRIC MATERIALS OF AN ELECTRICAL CONNECTION/INTERFACE IN AN OIL WELL ENVIRONMENT AND A METHOD OF FORMING THE SAME

CROSS-REFERENCE TO RELATED APPLICATION

This application claims the benefit of priority of U.S. provisional application No. 62/849,460, filed 17 May 2019, the contents of which are herein incorporated by reference.

BACKGROUND OF THE INVENTION

The present invention relates to protecting electrical conductors within an oil well and, more particularly, to using the deposition/application of a metallic layer onto a thermoplastic substrate to create an impermeable barrier between a metallic encapsulating material and a thermoplastic substrate.

In the oil and gas industry, a multitude of electrical devices are utilized to retrieve oil and gas. Cable, typically consisting of three heavy gauge copper conductors, individually insulated with a high dielectric material and wrapped by a continuous layer of a metallic encapsulating material, is used to provide power to the electrical devices.

The environment within the well in which the electrical devices are operated contain various harsh elements. These elements make the electrical connections within the well extremely susceptible to corrosion, fatigue, or damage which can ultimately lead to the disruption of the electrical conduction necessary to operate the electrical devices.

In order to enable the electrical connection to the cable, copper pins must be attached to the cable conductors. The process of attaching these pins involves removing a section of the protective layer of metallic encapsulating material and dielectric insulation from each cable conductor. A thermoplastic insulation sleeve with high dielectric properties for electrical insulation, as well as high temperature and chemical resistant properties, is used to protect the pin from harsh oil well elements.

Presently, the connection between the copper pins and cable is electrically insulated using high dielectric materials such as tapes and/or rubber; however, this does not provide any protection form the harsh well environment. Harsh oil well environments are extremely destructive to these high dielectric materials and will rapidly degrade their dielectric properties, which can cause a disruption of electrical conduction. This disruption of electrical conduction can potentially cause the electrical device to shut down, ultimately ceasing the production of oil.

In short, one side of an electrical connection/interface, such as a conducting pin may be protected by a thermoplastic substrate, while the other side of the electrical interface (e.g., a conductor cable) may be protected by a metallic encapsulating material; however, the engagement between the metallic encapsulating material and the thermoplastic substrate themselves is currently insufficient as a barrier against the harsh oil well environment.

As can be seen, there is a need for a protective barrier for the dielectric materials of an electrical connection/interface in an oil well environment. Once connected, the copper pin is insulated and protected from harsh well environment conditions by a thermoplastic material on one side of the connection; and the cable conductors are insulated and protected by continuous high dielectric material and continuous metal barrier sleeve or lead on the other side of the connection.

SUMMARY OF THE INVENTION

In one aspect of the present invention, a method of protecting an electrical interface in an oil well environment includes the following: depositing a metallic layer along an outer surface of a first insulating layer of a first conductor of the electrical interface; bonding a first end of a metallic encapsulating material to the metallic layer; and bonding a second end of the metallic encapsulating material to a metallic sleeve of a metallic barrier sleeve of a second insulating layer of a second conductor of the electrical interface, wherein the metallic encapsulating material circumscribes the electrical interface, wherein the first conductor is a pin, wherein the second conductor is a cable, and wherein the electrical interface is the pin operatively associated with the cable, wherein the first insulating layer is a thermoplastic material; and further including, prior to bonding the metallic encapsulating material, applying a dielectric material between the metallic layer and the metallic barrier sleeve and overlap the electrical connection, wherein a first side and an opposing second side of the dielectric material abuts the metallic layer and the metallic barrier sleeve, respectively.

In another aspect of the present invention, barrier system for preventing elements of an oil well environment from disrupting a dielectric material of an electrical interface includes the following: an insulation material on each side of the electrical interface; a deposition of metallic material on each insulation material; a deposition of the dielectric material between each insulation material; and a bond between a metallic encapsulating material and each metallic material in such a way that the dielectric material is completely sandwiched between the metallic encapsulating material, each metallic material, each insulation material, and the electrical interface.

These and other features, aspects and advantages of the present invention will become better understood with reference to the following drawings, description and claims.

DETAILED DESCRIPTION OF THE INVENTION

Figures 1, 2:
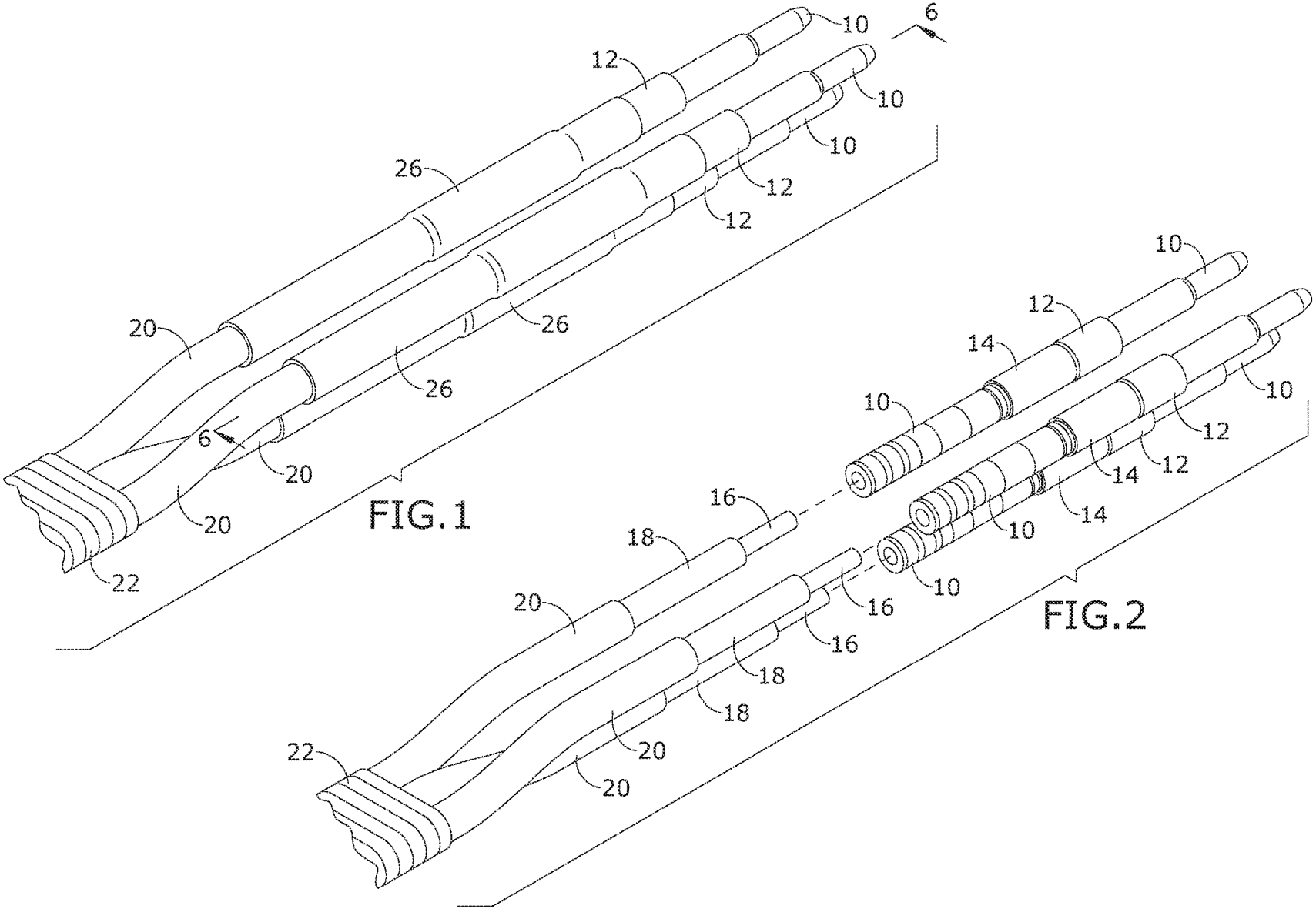
FIG. 1 is a perspective view of an exemplary embodiment of the present invention, with all materials applied.
FIG. 2 is a perspective exploded view of an exemplary embodiment of the present invention, illustrating the placement of conductor cables 16 into conducting pins 10.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a method for protecting an electrical interface in an oil well environment, the method providing the deposition/application of a metallic layer onto a thermoplastic substrate of a first conductor of the electrical interface to create an impermeable barrier between a metallic encapsulating material and the thermoplastic substrate.

The present invention may include a method of protecting an electrical interface 30 in an oil well or other similarly harsh environments having elements that corrode, fatigue and/or damage electrical connections. The electrical connection or interface 30 may be defined by the physical engagement between a conductor cable 16 and a conducting pin 10, or in certain embodiments a cable-pin assembly. The conducting material may be copper or the like.

The inventive method may embody the deposition/application of a metallic layer 14 onto a thermoplastic substrate 12 to create an impermeable barrier between a metallic encapsulating material 26 and the thermoplastic substrate 12 shielding an electrical interface 30, preventing the permeation of vapors, gases or liquids without compromising the dielectric strength of the electrical interface 30 and thus overall electrical system.

The thermoplastic substrate 12 may be materials that include, but are not limited to, PEEK, Arlon, Torlon, Ceramic, Teflon, PTFE, PFA and the like. As the thermoplastic substrate 12 coats a conducting pin 10, the thermoplastic substrate 12 may also be known as the thermoplastic insulating sleeve or just thermoplastic material.

The deposition/application metallic layer 14 materials may include but are not limited to gold, silver, tin, nickel, lead, and the like. The metallic encapsulating materials 26 may include but are not limited to lead, gold, silver, and the like.

In the prior art, a first side of the electrical interface 30 (e.g., the conducting pin 10) may be protected by the thermoplastic substrate 12, and the second side of the electrical interface 30 (e.g., the conducting cable 16) may be protected by an insulating sleeve 18. As a result, in the prior art, the connection between them is left unprotected from the harsh oil well environment. In order to effectively protect this connection/interface 30, the present invention may include/apply/deposit a layer of high dielectric material 24 over the interface 30 and the insulating sleeve 18 and the thermoplastic substrate 12 on opposing sides thereof. In effect, the high dielectric material 24 interconnects or bridges the metal barrier sleeve 20 of the second side and the metallic layer 14 of the first side. Overlaying the high dielectric material 24 (and the metal barrier sleeve 20 and the metallic layer 14 on opposing sides thereof) is the metallic encapsulating material 26 extending beyond the high dielectric material 24 along the first side so as to interface/bond with the metallic layer 14, wherein the metallic layer 14 interconnects the metallic encapsulating material 26 and the thermoplastic substrate 12 along the first side. The metallic layer 14 abuts or is adjacent to the interconnecting/bridging high dielectric material 24.

A bond between the metallic encapsulating material 26 to both the metallic layer 14 of the conducting pin 10 and the lead/metallic barrier sleeve 20 of the conductor cable 16 is critical in order to sufficiently prevent the harsh well environment from contacting the high dielectric elements. The metallic encapsulating material 26 can be bonded to the lead/metallic barrier sleeve 20 of the conducting cable 16 on the second side of the connection/interface 30. However on the opposite, first side of the connection/interface 30, the metallic encapsulating material 26 cannot be bonded directly to the thermoplastic material 12, but rather to the sandwiched metallic layer 14 between the thermoplastic material 12 and the metallic encapsulating material 26.

The technology of using the deposition/application of the metallic layer 14 onto thermoplastic substrate 12 enables the creation of a successful bond between the thermoplastic substrate 12 and metallic encapsulating material 26. This bond creates an impermeable barrier preventing the permeation of gas, vapors or liquids in the harsh well environment from attacking the insulating sleeve 18 material and the high dielectric materials 24.

Figure 3:
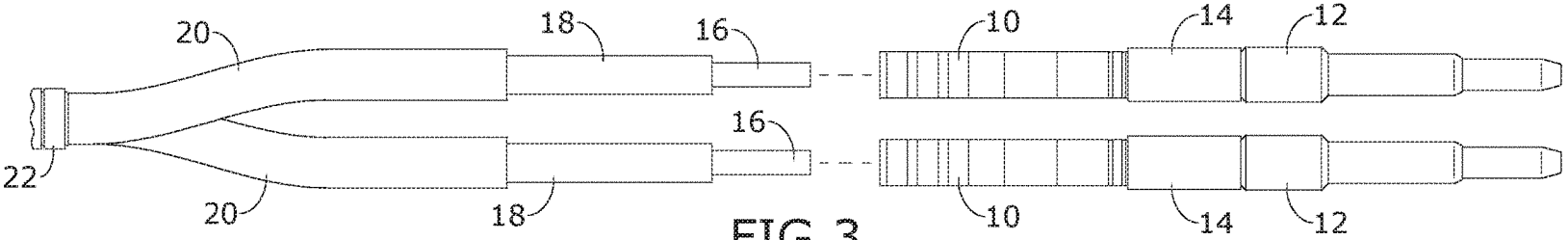
FIG. 3 is an elevation exploded view of an exemplary embodiment of the present invention, illustrating the placement of conductors 16 into copper pins 10.
Figure 4:
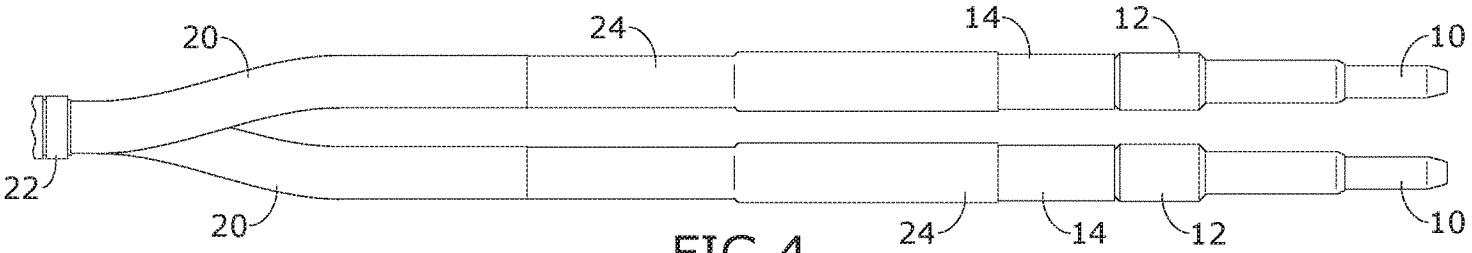
FIG. 4 is an elevation view of an exemplary embodiment of the present invention, showing high dielectric material 24 applied over the connected cable-pin interface 30, wherein the high dielectric material 24 ends at a location wherein a metallic layer 14 begins.
Figure 5:
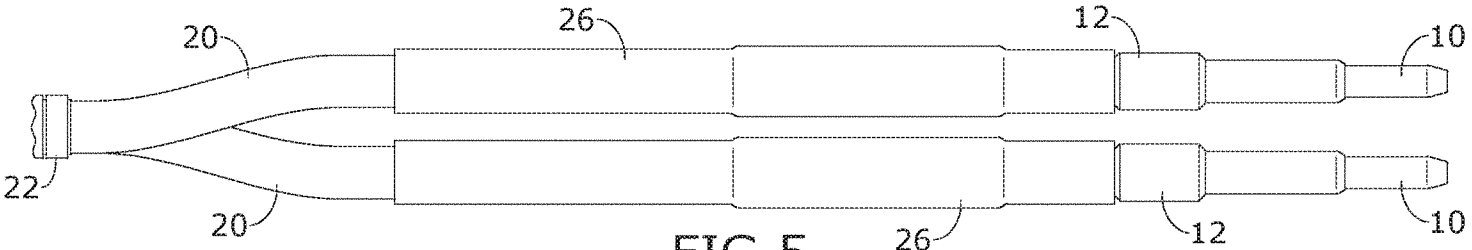
FIG. 5 is an elevation view of an exemplary embodiment of the present invention, with metallic encapsulating material 26 applied over both the high dielectric material 24 and the metallic layer 14 (shown in FIG. 4)
Figure 6:
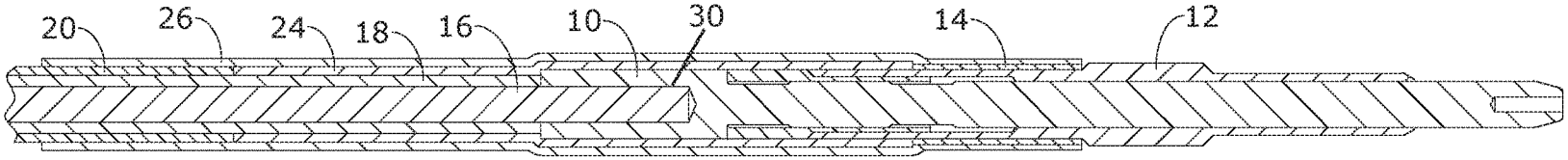
FIG. 6 is a section view of an exemplary embodiment of the present invention, taken along line 6-6 in FIG. 1.

Referring now to FIGS. 1 through 6, the present invention includes the following components:

- Thermoplastic Insulation Sleeve 12 with deposited/applied metallic layer;
- Conducting Pin 10;
- Insulating Sleeve 18 material (high dielectric tapes/rubber), used to insulate the connection between conducting cable 16 and pin 10;
- Metallic Encapsulating Material 26;
- Cable, made up of a plurality of conductor cables 16, bounded together with cable armor 22; and
- Power Pin Assembly, including the Thermoplastic Insulation Sleeve 12 with metallic layer 14 interface attached to the conducting pin 10.

The thermoplastic insulator sleeve 12 may be attached to the conducting pin 10, creating a power pin assembly—electrical connection/interface 30. The cable may be stripped back such that the three conductor cables 16 are exposed to connect the power pin assemblies (a conductor pin 10 and associated thermoplastic insulator sleeve 12). The power pin assemblies may be attached to the conductors 16, forming an electrical connection/interface 30. The insulating material 18 of the conductor cables 16 may terminate at the interface 30. High dielectric materials 24 may be used to cover and insulate the connection/interface 30 between the power pin assemblies and conductor cables 16. The metallic encapsulating material 26 may then be bonded to the metallic layer 14 of the thermoplastic insulator sleeve 12 and then to the metal barrier sleeve 20 or lead of the conductor cables 16.

This unique use of the deposition/application of a metallic layer 14 onto a thermoplastic substrate 12 enables an impermeable barrier between the thermoplastic substrate 12 and the metallic encapsulating material 26. Thus, preventing the permeation of vapors, gasses or liquids without compromising the dielectric strength of the system.

A method of making the present invention may include the following. A manufacturer may assemble the power pin 10 to conductor cable 16 as described above. The insulating material is used to insulate the connection/interface 30 between the conductor cables 16 and power pins 10. A metallic encapsulating material 26 is then bonded to the metallic layer 14 of the thermoplastic insulation sleeve 12 and then to the lead or metallic encapsulating material of the conductor cables 16. This bond on either side creates an impermeable barrier and therefore protects the insulation material 18 and 12 from any gases, vapors, or liquids of the harsh oil well environment. Once assembled properly, the assembly created above can now utilized to provide electrical power to various electrical devices within harsh oil well environments.

It should be understood, of course, that the foregoing relates to exemplary embodiments of the invention and that modifications may be made without departing from the spirit and scope of the invention as set forth in the following claims.

What is claimed is:

1. A method of protecting an electrical interface in an oil well environment, comprising:

depositing a metallic layer along an outer surface of a first insulating layer of a first conductor of the electrical interface;

bonding a first end of a metallic encapsulating material to the metallic layer; and bonding a second end of the metallic encapsulating material to a metallic sleeve of a metallic barrier sleeve of a second insulating layer of a second conductor of the electrical interface, wherein the metallic encapsulating material circumscribes the electrical interface, wherein the first conductor is a pin, wherein the second conductor is a cable, and wherein the electrical interface is the pin operatively associated with the cable, wherein the first insulating layer is a thermoplastic material; and wherein prior to bonding the metallic encapsulating material, applying a dielectric material between the metallic layer and the metallic barrier sleeve and overlap the electrical connection.

2. The method of claim 1, wherein a first side and an opposing second side of the dielectric material abuts the metallic layer and the metallic barrier sleeve, respectively.

3. A barrier system for preventing elements of an oil well environment from disrupting a dielectric material of an electrical interface, comprising:

an insulation material on each side of the electrical interface;

a deposition of metallic material on each insulation material;

a deposition of the dielectric material between each insulation material; and a bond between a metallic encapsulating material and each metallic material in such a way that the dielectric material is completely sandwiched between the metallic encapsulating material, each metallic material, each insulation material, and the electrical interface.

* * * * *